US008985185B2

(12) United States Patent
Tenold et al.

(10) Patent No.: US 8,985,185 B2
(45) Date of Patent: Mar. 24, 2015

(54) COMPOSITE COMPONENTS FORMED WITH LOOSE CERAMIC MATERIAL

(75) Inventors: Tyrus Neil Tenold, Spokane, WA (US); Gregory George Tenold, Spokane, WA (US); Robert Gordon Tenold, Spokane, WA (US); Edward Robert Kaczmarek, Spokane, WA (US); Rod Alan Grozdanich, Liberty Lake, WA (US)

(73) Assignee: Spokane Industries, Spokane, WA (US)

( * ) Notice: Subject to any disclaimer, the term of this patent is extended or adjusted under 35 U.S.C. 154(b) by 412 days.

(21) Appl. No.: 13/070,383

(22) Filed: Mar. 23, 2011

(65) Prior Publication Data

US 2012/0244341 A1 Sep. 27, 2012

(51) Int. Cl.
*B22D 19/14* (2006.01)

(52) U.S. Cl.
CPC ..... *B22D 19/14* (2013.01)
USPC ..... 164/97

(58) Field of Classification Search
USPC ..... 164/97, 98, 75, 100
See application file for complete search history.

(56) References Cited

U.S. PATENT DOCUMENTS

| | | | |
|---|---|---|---|
| 2,711,782 | A | 6/1955 | Clark et al. |
| 3,211,560 | A | 10/1965 | Fair |
| 3,705,558 | A | 12/1972 | McDougal et al. |
| 4,415,632 | A | 11/1983 | Luhleich et al. |
| 4,499,795 | A | 2/1985 | Radtke |
| 4,608,318 | A | 8/1986 | Makrides et al. |
| 4,876,941 | A | 10/1989 | Barnes et al. |
| 4,926,761 | A | 5/1990 | Haesebrouck |
| 5,081,774 | A | 1/1992 | Kuwano |
| 5,223,213 | A | 6/1993 | Kamimura et al. |
| 5,308,422 | A | 5/1994 | Askay et al. |
| 5,361,678 | A | 11/1994 | Roopchand et al. |
| 5,421,087 | A | 6/1995 | Newkirk et al. |
| 6,399,176 | B1 | 6/2002 | Francois |
| 6,520,241 | B2 | 2/2003 | Francois |
| 6,601,789 | B1 | 8/2003 | Bajadali et al. |
| 6,955,112 | B1 | 10/2005 | Adams et al. |
| RE39,998 | E | 1/2008 | Francois |
| 7,513,295 | B2 | 4/2009 | Poncin et al. |
| 7,617,757 | B2 | 11/2009 | Dickson |
| 7,820,299 | B2 | 10/2010 | Andreussi et al. |

(Continued)

FOREIGN PATENT DOCUMENTS

| | | |
|---|---|---|
| CN | 101624681(A) | 1/2010 |
| FR | 2 711 782 A1 | 7/1991 |

(Continued)

OTHER PUBLICATIONS

Carter et al., "Ceramic Materials: Science and Engineering," Springer, 2007, 4 pages.

(Continued)

*Primary Examiner* — Kevin P Kerns
(74) *Attorney, Agent, or Firm* — Lee & Hayes, PLLC

(57) ABSTRACT

An apparatus and methods for controlling the location and distribution of loose ceramic particles in a ceramic metal composite component formed via casting. A retaining structure that may include loose ceramic particles is placed in a casting mold at a desired location for ceramic particles in the composite component prior to pouring molten metal into the casting mold. Alternatively, the loose ceramic particles may be introduced into the mold concurrently with the molten metal.

13 Claims, 15 Drawing Sheets

(56) References Cited

U.S. PATENT DOCUMENTS

| | | | | |
|---|---|---|---|---|
| 7,833,627 | B1 | 11/2010 | Ferrando | |
| 7,837,086 | B2 | 11/2010 | Brice et al. | |
| 7,838,079 | B2 | 11/2010 | Chu et al. | |
| 7,866,248 | B2 | 1/2011 | Moore, III et al. | |
| 2002/0088340 | A1 | 7/2002 | Chu et al. | |
| 2002/0136857 | A1 | 9/2002 | Francois | |
| 2002/0166649 | A1* | 11/2002 | Gegel | 164/98 |
| 2004/0255768 | A1 | 12/2004 | Rettenbacher et al. | |
| 2005/0205229 | A1 | 9/2005 | Jiang et al. | |
| 2006/0269765 | A1 | 11/2006 | Collier et al. | |
| 2012/0240755 | A1 | 9/2012 | Tenold et al. | |
| 2012/0244344 | A1 | 9/2012 | Tenold et al. | |

FOREIGN PATENT DOCUMENTS

| | | | |
|---|---|---|---|
| FR | 2711782 | A1 | 5/1995 |
| JP | 56-026667 | | 3/1981 |
| JP | 60-127067 | A | 6/1985 |
| WO | WO03078158 | A1 | 9/2003 |

OTHER PUBLICATIONS

Anderson, "A review of Computatonal Ceramic Armor Modeling", Ceramic Engineering and Science Proceedings, Copyright 2007, retrieved at <<http://dev.ceramics.org/wp-content/uploads/2009/05/cesp-volume-27-issue-7-ceramic-armor-chapter-1-anderson.pdf>>, 18 pages.

Howell et al., "Advancements in Steel for Weight Reduction of P900 Armor Plate," Iron & Steel Technology, AIST Transactions, May 2009, vol. 6, No. 5 , p. 168.

The PCT Search Report mailed Feb. 13, 2013 for PCT application No. PCT/US12/30426, 14 pages.

Final Office Action for U.S. Appl. No. 13/070,418, mailed on Nov. 8, 2013, Tyrus Neil Tenold, "Composite Components Formed by Coating a Mold With Ceramic Material," 9 pages.

"Nature of Thermal Spray Coatings," retrieved on Oct. 23, 2013 at <<http://web.archive.org/web/20010222103733/http://www.gordonengland.co.uk/tsc.htm>> 7 pages.

"Definition: Alloy," Hawley's Condensed Chemical Dictionary, 14th Edition, John Wiley & Sons, Inc., 2002, 1 page.

"Definition: Aluminum Alloy," Hawley's Condensed Chemical Dictionary, 14th Edition, John Wiley & Sons, Inc., 2002, 1 page.

Keough et al., "Austempering of Steel," Reprinted from ASM Handbook, vol. 4, Heat Treating, ASM International, 1991, pp. 152-163.

Office Action for U.S. Appl. No. 13/070,406, mailed on Apr. 11, 2014, Tyrus Neil Tenold, "Ballistic Applications of Composite Materials," 37 pages.

Office action for U.S. Appl. No. 13/070,418, mailed on Jul. 2, 2014, Tenold et al., "Composite Components Formed by Coating a Mold With Ceramic Material," 18 pages.

Final Office Action for U.S. Appl. No. 13/070,406, mailed on Oct. 17, 2014, Tyrus Neil Tenold, "Ballistic Applications of Composite Materials", 21 pages.

Non-Final Office Action for U.S. Appl. No. 13/070,406, mailed on Feb. 25, 2013, Tyrus Neil Temold et al., "Ballistic Applications of Composite Materials", 10 pages.

Non-Final Office Action for U.S. Appl. No. 13/070,418, mailed on May 23, 2013, Tyrus Neil Tenold et al., "Composite Components Formed by Coating a Mold With Ceramic Material", 10 pages.

Office action for U.S. Appl. No. 13/070,406, mailed on Jul. 17, 2013, Tenold et al., "Ballistic Applications of Composite Materials", 13 pages.

* cited by examiner

COMPOSITE COMPONENTS FORMED WITH LOOSE CERAMIC MATERIAL

BACKGROUND

Wear or impact resistant components are desirable in a variety of industrial, commercial, and military applications. For example, mining, construction, heavy equipment, automotive, military, and other applications rely on components that are resistant to wear and impact.

Recently, composite components formed of two materials having different material properties have been used. For example, a composite component may be made by combining a first material having a high hardness with a second material having a high toughness, to produce a composite component having characteristics of both materials (i.e., high hardness and toughness).

However, manufacturing composite components is often challenging due to the different properties of materials used to form the composite component. For example, different materials often have different coefficients of thermal expansion, different densities, different melting points, etc. A manufacturing process that works well for one material may not be compatible with another material. For example, if two materials have different coefficients of thermal expansion, they will expand or contract at different rates. If the difference between coefficients of thermal expansion is significant, cracks and/or voids may form as a composite component made from the materials cools, thereby detracting from the performance of the composite material.

Thus, there remains a need to develop new composite materials and methods of manufacturing such composite materials.

BRIEF SUMMARY

This Brief Summary is provided to introduce simplified concepts relating to techniques for casting composite components including ceramic material and a base metal, which are further described below in the Detailed Description. This Summary is not intended to identify essential features of the claimed subject matter, nor is it intended for use in determining the scope of the claimed subject matter.

This disclosure relates to composite components that are subject to wear (so called "wear parts") and/or impacts and techniques for forming such components. The composite components generally comprise a base metal having a ceramic material embedded therein. The composite components exhibit improved resistance to wear and/or impact and, therefore, have a longer usable life or higher impact resistance than components formed of the base metal or ceramic material alone. Composite components may be used to improve a usable life of virtually any wear part and/or to improve protection against ballistic or other impacts. While in some examples, ceramic material may be distributed uniformly throughout a component, in other examples, ceramic material may be distributed non-uniformly throughout all or part of a composite component.

In one example, a composite component may be formed by placing one or more ceramic cores in a mold and introducing molten base metal into the mold, such that the molten base metal encapsulates the one or more ceramic cores to form the composite component. The ceramic cores may be configured as porous ceramic cores made of ceramic particles held together with an adhesive. The base metal, when introduced into the mold, substantially permeates the porous ceramic core. Composite materials formed using this technique may be used for a variety of applications including, for example, as ballistic resistant armor for military vehicles, as a ground engaging tool, or as a wear surface to resist sliding abrasion.

In another example, a composite component may be formed by introducing loose ceramic particles into a mold with a molten base metal. The loose ceramic particles may be introduced into the mold prior to or contemporaneously with the base metal. In some examples, the loose ceramic particles may be held in place in a desired location in the mold by a retaining structure that is permeable by the molten metal. The retaining structure may comprise, for example, a metal mesh, a ceramic mesh, a fabric, or other suitable structure that can retain the particles at a desired location in the mold during the casting process. A portion of the retaining structure may be defined by a wall of the mold. In other examples, the loose ceramic particles may be unconstrained and may simply be poured into the mold prior to or contemporaneously with the molten metal. In that case, the size, shape, amount, and materials of ceramic particles used may be chosen based on the desired composite material properties and the desired location and uniformity of the loose ceramic particles in the composite component. The flow rate and density, temperature, and turbulence of the molten metal, as well as the introduction rate, density, and temperature of the ceramic particles may also be chosen to achieve the desired composite material properties and the desired location and uniformity of the loose ceramic particles in the composite component.

In yet another example, a composite component may be formed by applying a ceramic material to a predetermined location within a mold cavity to create a ceramic film. The ceramic material may be applied to the mold cavity by coating all or part of the mold cavity with adhesive and ceramic material. The adhesive and ceramic material may be applied concurrently (e.g., as a slurry or mixture of ceramic and adhesive) or sequentially (e.g., by applying the adhesive first and then applying the ceramic material). The adhesive and/or ceramic material may be applied by, for example, brushing them onto the mold cavity, spraying them onto the mold cavity, and/or sifting them onto the mold cavity. One or more layers of ceramic film may be applied to the mold cavity using any of the techniques described herein. Molten base metal may then be introduced into the mold cavity. The molten base metal may partially, substantially, or completely permeate the ceramic film, and may encapsulate the ceramic material. In some examples, the ceramic material comprises ceramic particles and the molten base metal substantially permeates interstitial spaces between the ceramic particles.

In summary, the distribution or location of the ceramic materials within the composite components described above may be manipulated to improve the wear or impact characteristics described above. Moreover, a variety of different metals may be used as a base metal for any or all of the embodiments and techniques described herein. As one example, the base metal may comprise a steel alloy, such as FeMnAl. As used herein, the term "steel" includes alloys of iron and carbon, which may or may not include other constituents such as, for example, manganese, aluminum, chromium, nickel, molybdenum, copper, tungsten, cobalt, and/or silicon. As used herein, the term FeMnAl includes any alloy including iron, manganese, and aluminum in any amounts greater than impurity levels. The techniques described herein may be used singly or in combination, depending on the desired characteristics of the composite components. The techniques to control the distribution or location of the ceramic materials will be discussed further below in the Detailed Description.

BRIEF DESCRIPTION OF THE DRAWINGS

The Detailed Description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
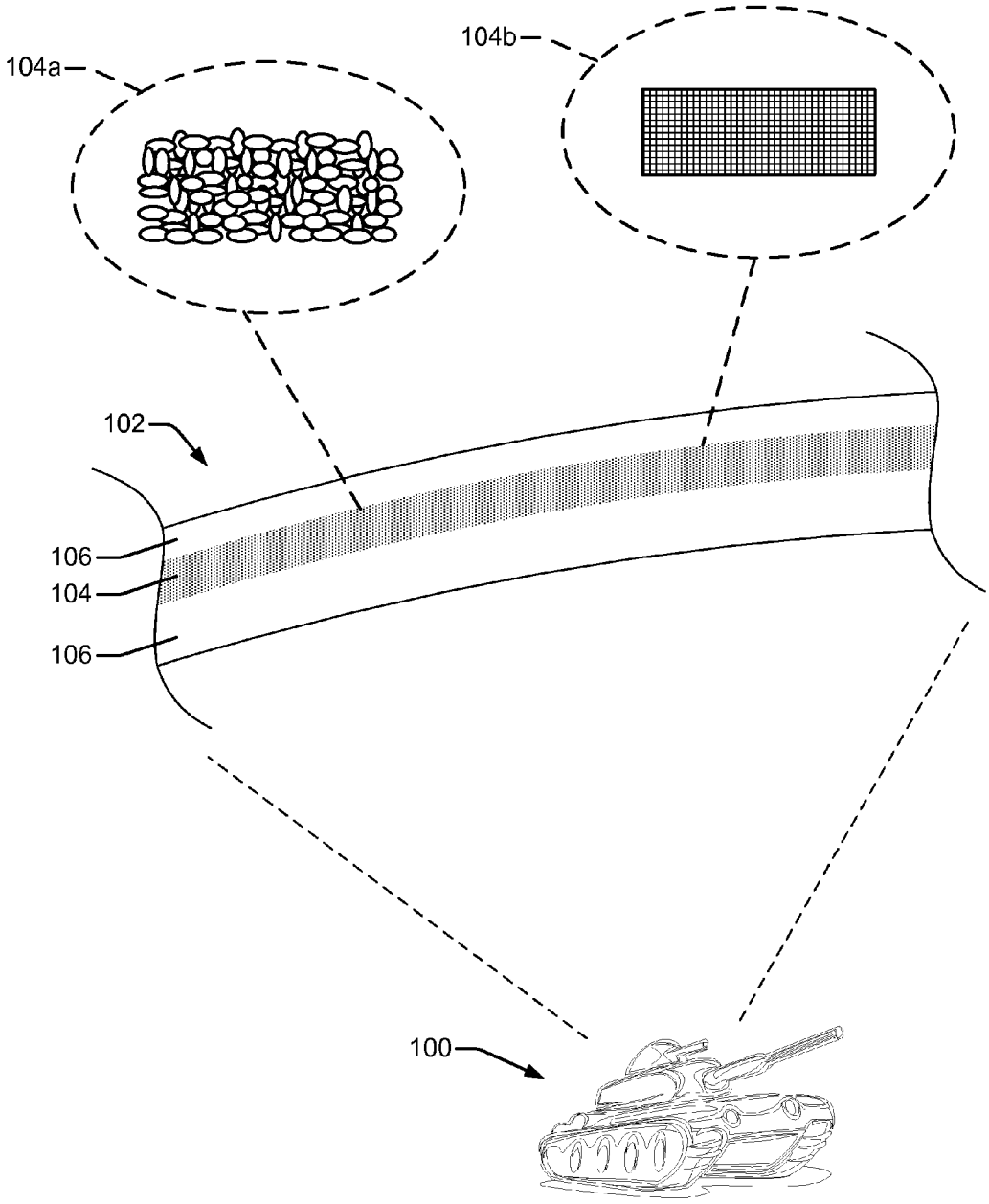
FIG. 1 is a schematic diagram of a vehicle having an example composite ballistic armor comprising ceramic material and a base metal.

As noted above, manufacturing of composite components is often difficult due to the varying material properties of the materials from which the composite component is made. This application describes composite components comprising ceramics and metal or metal alloy(s) that, together, exhibit improved resistance to wear, friction, and/or impact compared with components formed of ceramic or metal alone. This application also describes various techniques for manufacturing such composite components. By way of example and not limitation, the composite components described herein may be used in the fields of excavation, manufacturing, metallurgy, milling, material handling, transportation, construction, military applications, and the like.

In general, composite components as described in this application include a base metal and one or more ceramic materials. This application describes techniques for casting such composite components in sand and/or investment casting molds. In some embodiments, the ceramic materials are embedded in the base metal in the form of ceramic inserts or cores that are encapsulated within the base metal. In other embodiments, the ceramic materials may comprise loose particles or grains of ceramic material placed in a mold prior to or contemporaneously with introduction of a molten metal or metal alloy. In yet another embodiment, the ceramic material may be coated or coupled to portions of the mold prior to introducing the molten metal or metal alloys into the mold. Composite components formed using the techniques described herein can be said to have the ceramic material distributed non-uniformly, in so far as the ceramic material is not evenly distributed throughout the entire component. Rather, the ceramic material in the embodiments described herein is localized at one or more predetermined locations of the part. The techniques described herein may be used singly or in combination, depending on the desired characteristics of the composite components.

The embodiments described herein employ carbon steel or an alloy of steel, as the base metal. However, in other embodiments, other metals may be used such as, for example, iron, aluminum, manganese, stainless steel, copper, nickel, alloys of any of these, or the like. In one specific example, FeMnAl alloy may be used as a base metal for a composite material. In another specific example, high-chrome iron (or white iron) may be used as a base metal for a composite material.

Also, while the embodiments described herein employ alumina and/or zirconia as the ceramic material, other ceramic materials may also be used such as, for example, tungsten carbide, titanium carbide, zirconia-toughened alumina (ZTA), partially stabilized zirconia (PSZ) ceramic, silicon carbide, silicon oxides, aluminum oxides with carbides, titanium oxide, brown fused alumina, combinations of any of these, or the like. Moreover, while the embodiments discussed herein describe using relatively small particles of ceramic materials (e.g., having a particles size in the range of about 0.03 inches to about 0.22 inches, about 0.7 mm to about 5.5 mm), the ceramic materials could alternatively be provided in other sizes (e.g., larger or smaller particles) or forms (e.g., precast unitary cores as opposed to cores formed of small particles or as loose particles). In some examples, using smaller particles may help to minimize stresses and cracking due to differences in thermal expansion between the base metal and the ceramic particles.

In one embodiment, the ceramic materials comprise ceramic particles made of alumina and zirconia. The relative content of alumina and zirconia of the ceramic material may vary depending on the desired toughness, hardness, and thermal expansion characteristics of the composite component. In general, increasing an amount of alumina will increase a hardness of the composite component, while increasing an amount of zirconia will increase the toughness. In addition, zirconia has a coefficient of thermal expansion that closely matches that of iron and steel and, therefore, minimizes internal stresses and cracking of the composite components. These ceramic grains may be manufactured by any known technique, such as by electrofusion, sintering, flame spraying, or by any other process allowing the two constituents (alumina and zirconia) to fuse.

These and other aspects of the composite materials and components will be described in greater detail below with reference to several illustrative embodiments.

Example Methods of Forming Composite Components Using Ceramic Cores

This section describes an example in which a composite component may be formed by placing one or more ceramic cores in a mold and introducing molten base metal into the mold, such that the molten base metal encapsulates the one or more ceramic cores to form the composite component. In some implementations, the ceramic cores may be configured as porous ceramic cores made of ceramic particles held together with an adhesive, while in other implementations the cores may comprise pre-cast porous cores. The base metal, when introduced into the mold, substantially permeates the porous ceramic cores. Composite materials formed using this technique may be used for a variety of applications including, for example, as ballistic resistant armor for military vehicles, as a ground engaging tool, or as a wear surface to resist sliding abrasion. These and numerous other composite components can be formed according to the techniques described in this section.

FIG. 1 is a schematic diagram of a vehicle 100 having an example composite ballistic armor, an enlarged detail view of which is shown at 102. Metal/ceramic materials are well suited to ballistic-resistant applications due to the characteristics of the materials. For example, metals typically provide a relatively high strength-to-weight ratio and a high toughness, while ceramics have a relatively high hardness. Additionally, because the crack propagation speed of ceramics is below the speed of a ballistic projectile, ceramic materials provide extremely strong defense to ballistic impacts.

As shown in FIG. 1, the composite ballistic armor 102 comprises a sheet of composite material having one or more porous ceramic cores 104 encapsulated in a base metal 106. As used herein a "sheet" means a portion of something that is thin in comparison to its length and breadth. A sheet may have any desired contour and is not limited to being planar. The porous ceramic cores 104 may be formed in a variety of ways. In one example, packed-particle porous ceramic cores 104*a* may comprise ceramic particles held together with an adhesive in a desired shape and size. In another example, precast porous ceramic cores 104*b* may comprise a ceramic lattice or mesh-like structure formed in a desired shape and size. Regardless of the type of porous ceramic cores used, the porous ceramic cores 104 are configured such that the base metal 106 is able to substantially permeate the porous ceramic core 104 during the casting process. In the case of porous ceramic cores 104*a* formed from ceramic particles, during the casting process the base metal 106 flows into and fills the interstitial spaces between the particles during the casting process.

As noted above, the base metal may comprise a variety of different metals. However, in the ballistic armor example of FIG. 1, the base metal comprises a steel alloy, such as FeMnAl, an aluminum alloy, or other metals having a relatively high strength-to-weight ratio, toughness, and/or hardness.

Figure 2A:
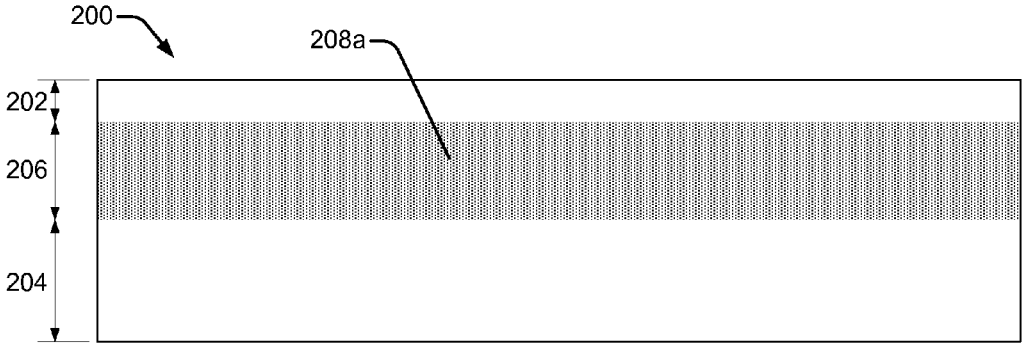
FIGS. 2A, 2B, and 2C are schematic diagrams of example composite materials having three different embodiments of ceramic cores encapsulated in a base metal.
Figure 2B:
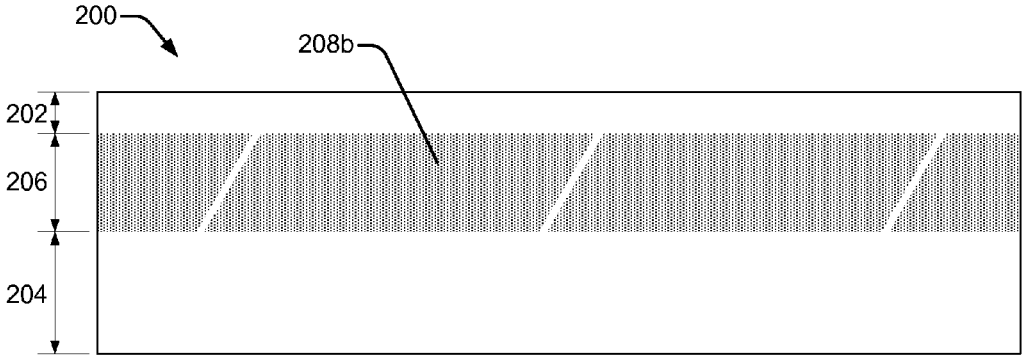
Figure 2C:
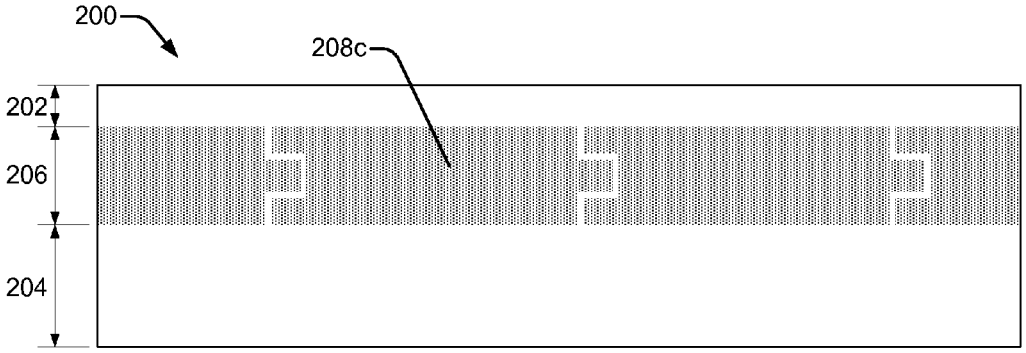

FIGS. 2A-2C illustrate three embodiments of ceramic cores that may be used to form composite components, such as the composite ballistic armor of FIG. 1. In all three embodiments, a sheet of composite material 200 comprises a plurality of strata, including an outer stratum 202 of solid base metal, an inner stratum 204 of solid base metal, and a composite stratum 206, interposed between the outer stratum and the inner stratum. The composite stratum 206 comprises one or more porous ceramic cores encapsulated in and substantially permeated by base metal.

In the embodiment of FIG. 2A, the composite stratum 206 is composed of a single ceramic core 208*a*, which is thinner than, but is substantially coextensive with the sheet of composite material 200. In this embodiment, the ceramic core 208*a* is shaped to match the contours of a mold used to cast the sheet 200 of the composite component. The ceramic core 208*a* may be formed in a variety of known techniques, such as packing ceramic particles into a core mold and holding the ceramic particles together with an adhesive. Once the ceramic core 208*a* is set, it may be removed from the core mold and placed in a mold used for casting the composite component.

In the embodiments of FIG. 2B and FIG. 2C, the composite stratum 206 is composed of a plurality of porous ceramic cores 208*b* and 208*c* arranged to provide a substantially uniform, continuous thickness of porous ceramic cores that extends substantially coextensively with the sheet of composite material. In the embodiment of FIG. 2B, the porous ceramic cores 208*b* have a generally rhomboidal cross-section. The porous ceramic cores 208*b* of this embodiment are arranged in an overlapping fashion, as shown in FIG. 2B, such that a thickness of the composite stratum 206 is substantially uniform along a length of the sheet of composite material 200. In the embodiment of FIG. 2C, the porous ceramic cores 208*c* have a tongue-and-groove cross-section. The porous ceramic cores 208*c* of this embodiment are arranged with a tongue of one porous ceramic core 208*c* received in a groove of an adjacent porous ceramic core 208*c*, as shown in FIG. 2C, such that a thickness of the composite stratum 206 is substantially uniform along a length of the sheet of composite material 200.

The sheet of composite material 200 may have any desired thickness. Moreover, the relative thicknesses of the strata 202, 204, and 206 may vary depending on the application. However, when used for a ballistic armor application, such as that shown in FIG. 1, the sheet of composite material may have a thickness of at least about 1 inch and at most about 4 inches. Generally, in such ballistic armor applications, the outer stratum may be thinner than each of the inner stratum and the composite stratum. For example, the outer stratum 202 may have a thickness of at least about 0.125 inches and at most about 0.5 inches, the inner stratum 204 may have a thickness of at least about 0.5 inches and at most about 1.5 inches, and the composite stratum 206 may have a thickness of at least about 0.5 inch and at most about 2 inches. In one specific example, the outer stratum 202 may have a thickness of about 0.25 inches, the inner stratum 204 may have a thickness of about 0.75 inches, and the composite stratum 206 may have a thickness of at least about 0.75 inch and at most about 1 inch.

In some embodiments, the base metal used for the outer stratum 202, the inner stratum 204, and the composite stratum 206 may be the same. However, in other embodiments, different alloys and/or different metals may be used for one or more of the strata. For example, a harder alloy may be used for the outer stratum 202 to provide deflect impacts, while a softer yet tougher alloy may be used for the inner stratum 204 and/or the composite stratum 206 to absorb energy of incoming projectiles and to minimize cracking of the composite stratum 206. Whether formed using a single base metal or multiple different base metals or alloys, the outer stratum 202, inner stratum 204, and the composite stratum 206 may be formed integrally as a single casting.

In one specific example, the outer stratum 202, inner stratum 204, and the composite stratum 206 comprise FeMnAl as the base metal. In other specific example, the composite stratum 206 comprises FeMnAl as the base metal, while the outer stratum 202 and/or the inner stratum 204 comprise a steel alloy other than FeMnAl.

Figure 3A:
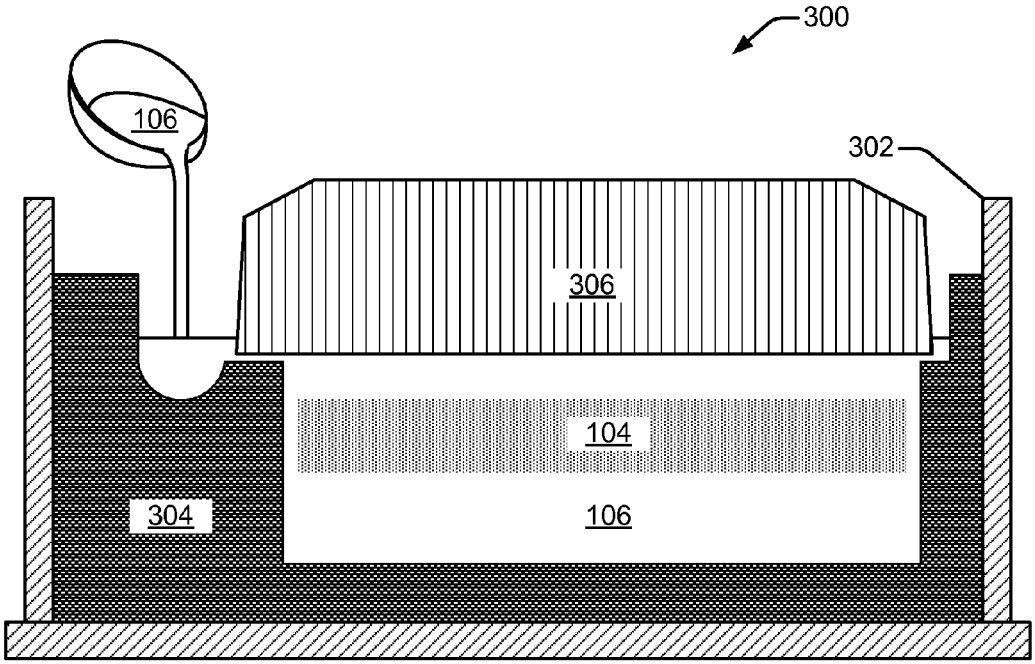
FIGS. 3A and 3B are schematic diagrams of a sand mold and an investment casting mold, respectively, usable to form example composite components using ceramic cores.

The composite ballistic armor 102 of FIG. 1 and other composite components may be cast using sand casting techniques or investment casting techniques. FIG. 3A is a schematic diagram illustrating a simplified example sand casting process usable to cast composite components, such as the composite ballistic armor of FIG. 1. As shown in FIG. 3A, a casting mold 300 is formed in a shape configured to produce a desired composite component. The casting mold 300 includes a sand container 302 and a sand mold 304 that may be formed or arranged to facilitate the casting of a composite component of various geometries. The mold geometries shown in FIG. 3A are for component with a simple rectangular cross section. However, in other embodiments molds may be configured for components of any desired shape, size, and configuration. A pressing a riser 306 is provided to press down against the sand mold 304 to form a top surface of the composite component.

Figure 3B:
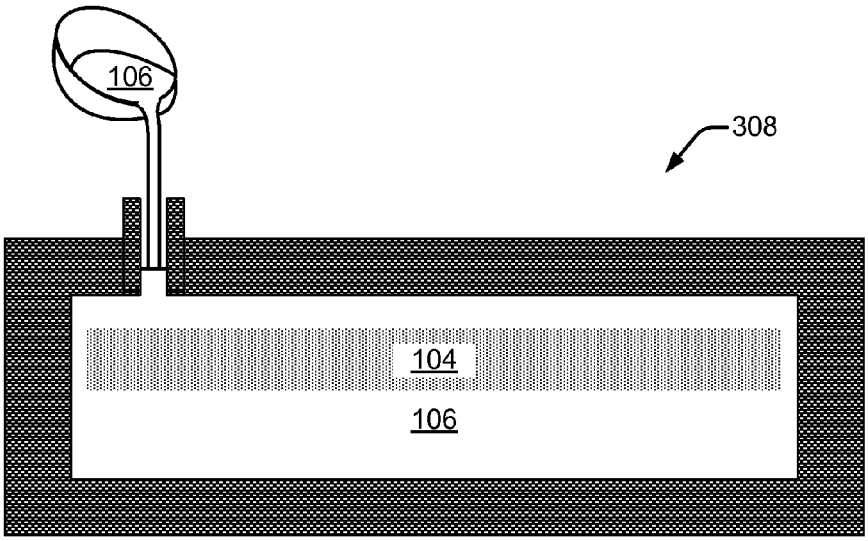

FIG. 3B is a schematic diagram illustrating a simplified example investment casting process usable to cast composite components, such as the composite ballistic armor of FIG. 1. As shown in FIG. 3B, an investment casting mold 308 is formed of a refractory material in a shape configured to produce a desired composite component.

In both FIGS. 3A and 3B, molten base metal 106 is shown being poured into the casting mold 300,308 and permeating a porous ceramic core 104 to form the composite component.

Figure 4:
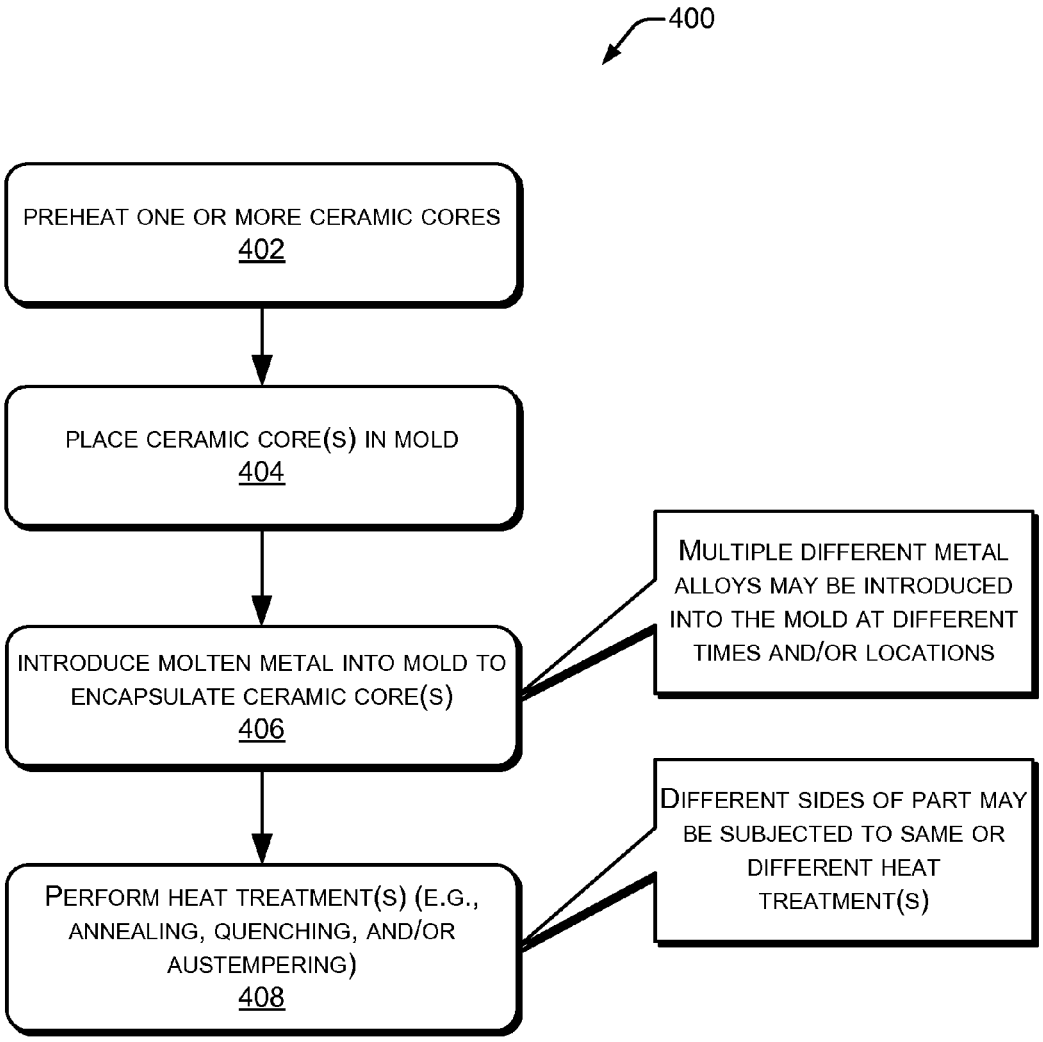
FIG. 4 is a flow diagram illustrating an example process of casting a composite component having one or more ceramic cores encapsulated in a base metal.

FIG. 4 is a flow diagram illustrating a process 400 that may, but need not necessarily, be used to cast composite components, such as the ballistic armor of FIG. 1. However, the process 400 is usable to make a variety of other composite components including, without limitation, those listed elsewhere in this application. The process 400 includes, at 402, preheating one or more ceramic cores in a sand or investment mold and, at 404, placing the ceramic cores in the mold. In the case of an investment mold, placing a ceramic core in an investment mold may include forming the investment mold around the ceramic core. Depending on the process, the ceramic cores may be preheated prior to or after being placed in the mold. That is, the ceramic cores may be preheated and then placed in the mold, or (at least in the case of investment casting) may be placed in the mold and then preheated in situ. The ceramic cores may comprise porous ceramic cores, such as the packed-particle porous ceramic cores 104*a* and/or precast porous ceramic cores 104*b* shown in FIG. 1. At 406, one or more molten base metals may be introduced into the mold to partially, substantially, or completely encapsulate the ceramic material. In one example, the molten base metal may comprise a steel alloy, such as FeMnAl. In other embodiments, multiple different molten base metals may be introduced into the mold at different locations and/or times. For example, a first base metal may be poured at a first time, and a second, different base metal may be poured at a second, later time during the same casting process. As another example, two different base metals may be introduced into the mold at different locations of the mold (e.g., using different sprues).

At 408, the cast composite component may be subjected to one or more heat treatments or post processing operations, such as machining, heat treating (e.g., quenching, annealing, tempering, austempering, cryogenic hardening, etc.), polishing, or the like. Additional details of various heat treatments and post processing operations are described further below in the section entitled "Illustrative Manufacturing Processes." In some implementations, different heat treatment operations may be applied to different sides of a composite component. For example, a first heat treatment operation may be applied to a first side of a ballistic-resistant part (e.g., to harden the first side) and a second heat treatment operation may be applied to a second side of the ballistic-resistant part (e.g., to relieve stresses or increase a ductility of the second side).

Example Methods of Forming Composite Components Using Loose Particles

This section describes examples, in which a composite component may be formed by introducing loose ceramic particles into a mold with a molten base metal. The loose ceramic particles may be introduced into the mold prior to or contemporaneously with the base metal. In some examples, the loose ceramic particles may be held in place in a desired location in the mold by a retaining structure that is permeable by the molten metal. The retaining structure may comprise, for example, a metal mesh, a ceramic mesh, a fabric, or other suitable structure that can retain the particles at a desired location in the mold during the casting process. A portion of the retaining structure may be defined by a wall of the mold.

In other examples, the loose ceramic particles may be unconstrained and may simply be poured into the mold prior to or contemporaneously with the molten metal. In that case, the size, shape, amount, and materials of ceramic particles used may be chosen based on the desired composite material properties and the desired location and uniformity of the loose ceramic particles in the composite component. The flow rate and density, temperature, and turbulence of the molten metal, as well as the introduction rate, density, and temperature of the ceramic particles may also be chosen to achieve the desired composite material properties and the desired location and uniformity of the loose ceramic particles in the composite component.

Figure 5:
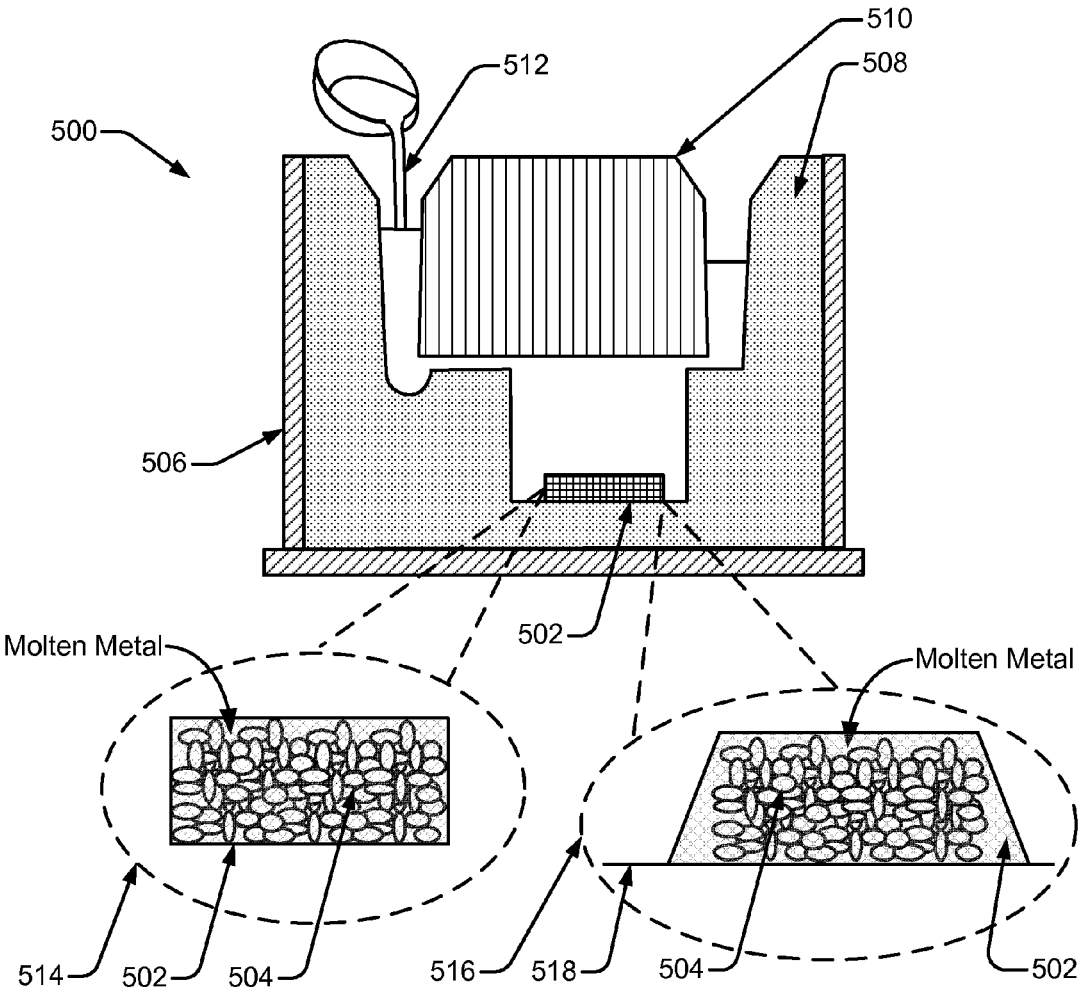
FIG. 5 is a schematic diagram of a casting mold that includes a retaining structure for loose ceramic particles.

FIG. 5 is a diagram of a casting mold 500 for casting composite components (i.e., metal-ceramic components) that includes a retaining structure 502 to secure loose ceramic particles 504 during the casting process. The casting mold 500 includes a sand container 506 and a sand mold 508 that may be formed or arranged to facilitate the casting of a metal ceramic part of various geometries. By way of example and not limitation, FIG. 5 shows the sand mold 508 formed to cast a square or rectangular composite component with a combination of substantially horizontal and substantially vertical surfaces. The retaining structure 502 is shown to be in contact with one of the substantially horizontal surfaces molded into the sand 508 in FIG. 5. The top surface of the composite component formed by casting mold 500 is formed by pressing a riser 510 down against the sand mold 508 to form the molten metal 512 into a desired shape for the composite component. The molten metal 512 is shown being poured into the casting mold 500 in FIG. 5. In the illustrated example, a single retaining structure 502 is centered on the horizontal surface of the casting mold 500. However, more than one retaining structure 502 may be placed in the sand mold 508 during the casting process. Moreover, the size, shape, and location of the retaining structure may be configured based on the requirements of the composite component to be cast. Additional embodiments that may use more than one retaining structure will be described in the discussion of FIGS. 6B and 6C.

The retaining structure 502 secures the loose ceramic particles 504 to a desired location within the casting mold 500 such that the composite component produced by the casting mold 500 has the ceramic particles localized in a desired location based on the intended use of the composite component. For example, the retaining structure 502 may hold the ceramic particles in place at location of the composite component that is anticipated to receive higher abrasion to provide a harder wear surface. The retaining structure 502 may comprise any structure that is permeable to molten metal and impermeable to the loose ceramic particles 504. For example, the retaining structure 502 may be arranged as a mesh structure made of metal wire or fabric that can maintain their structural integrity when exposed to the molten metal 512. Also, in one embodiment, the mesh structure may only need to maintain structural integrity for a small period of time when exposed to the molten metal and may not need to maintain perfect structural integrity for the entire casting process. Additionally, the retaining structure 502 may melt or dissolve during the casting process but resist the molten metal long enough such that the loose ceramic particles 508 are secured in the desired location prior to melting or dissolving of the retaining structure 502. Examples retaining structures include, without limitation, steel or other metal meshes or wire frames, high temperature fabrics (e.g., those made of Teflon®, Kevlar®, or the like), or ceramic meshes or frames.

In one embodiment, as illustrated by 514, the retaining structure 502 may have ceramic particles 504 completely enclosed within the retaining structure 502. The retaining structure may be placed or secured to any surface within the casting mold 500. Additionally, more than one type of ceramic material may be included within the same retaining structure 502.

In another embodiment, as illustrated by 516, the retaining structure 502 is in contact with or secured to a surface 518 of the casting mold with the loose ceramic particles 504 being secured between the retaining structure 502 and the casting mold surface 518.

Figure 6A:
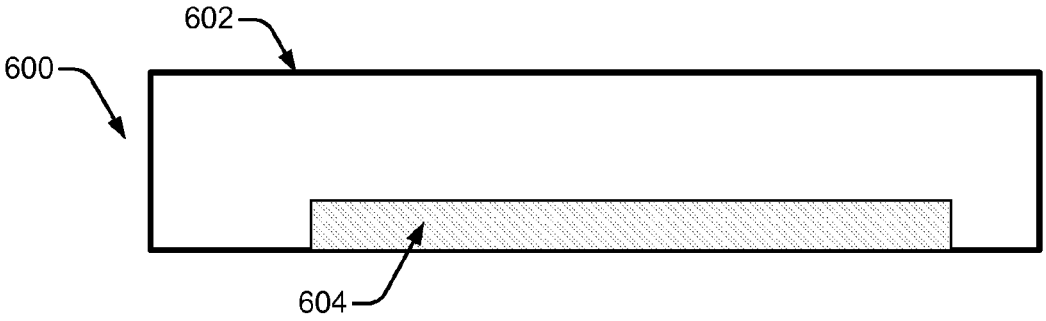
FIGS. 6A, 6B, and 6C are schematic diagrams of composite components formed by a ceramic-metal casting process.
Figure 6B:
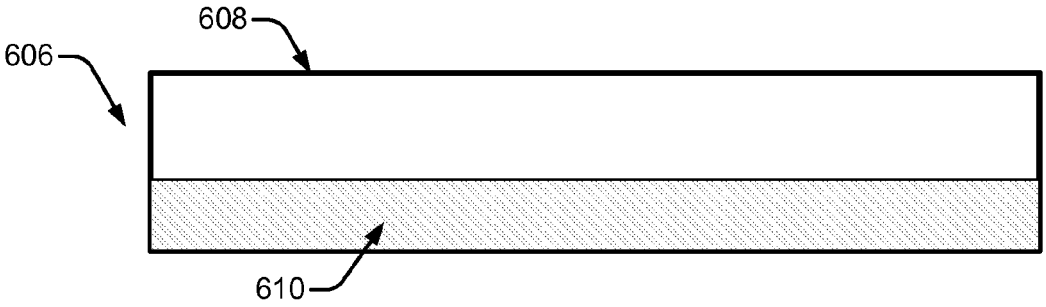
Figure 6C:
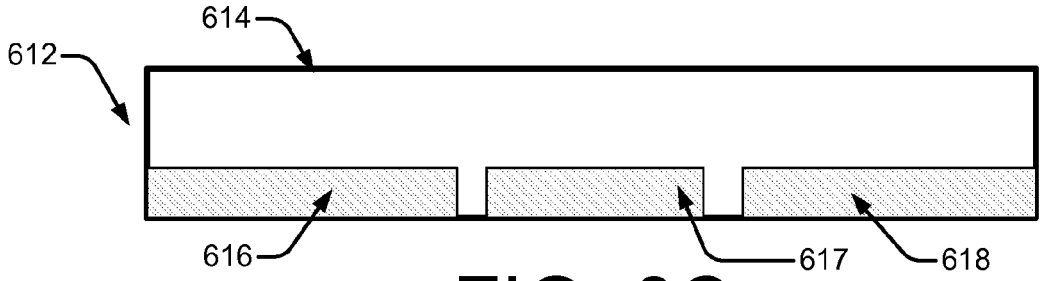

FIGS. 6A-6C illustrate additional embodiments related to the placement of the retaining structure 502 in the casting mold 500 to provide different configurations of the composite component. FIG. 6A provides a representative example of a composite component 600 produced by the casting mold 500 embodiment illustrated in FIG. 5. The composite component 600 includes a metal portion 602 and a ceramic-metal portion 604. The location of the ceramic-metal portion 604 was imparted to the composite component 600 by placing the retaining structure(s) 502 at a corresponding location(s) within the casting mold 500. Although FIG. 6A shows that the ceramic-metal portion 604 is centered on the bottom surface of the composite component 600, the ceramic-metal portion 604 may be positioned anywhere along any surface of the composite component 600. Further, the ceramic-metal portion 604 may have the ceramic particles distributed in a non-uniform manner, such that the non-uniformity of the ceramic material within the ceramic-metal portion 604 is greater than or equal to 10%. Put differently, in this example, the ceramic-metal portion 604 constitutes at most 10% of the total volume of the composite component.

FIG. 6B is an illustration of a composite component 606 that includes a metal portion 608 and a ceramic-metal portion 610 that spans the entire bottom surface of the composite component 606. Also, the ceramic-metal portion 610 may include a portion of the side surfaces of composite component 606.

FIG. 6C illustrates another embodiment of the composite component 612 that includes a metal portion 614 and ceramic-metal portions 616, 617, and 618. This illustrated arrangement may be produced by using multiple retaining structures 502 during the casting process. The ceramic-metal portions may be arranged according to the intended use of the composite component. For example, the coverage of the ceramic-metal portions may be configured to account for wear along the bottom surface. Also, the depth of the ceramic-metal portion into the composite component 612 may be varied based on the intended use.

Figure 7:
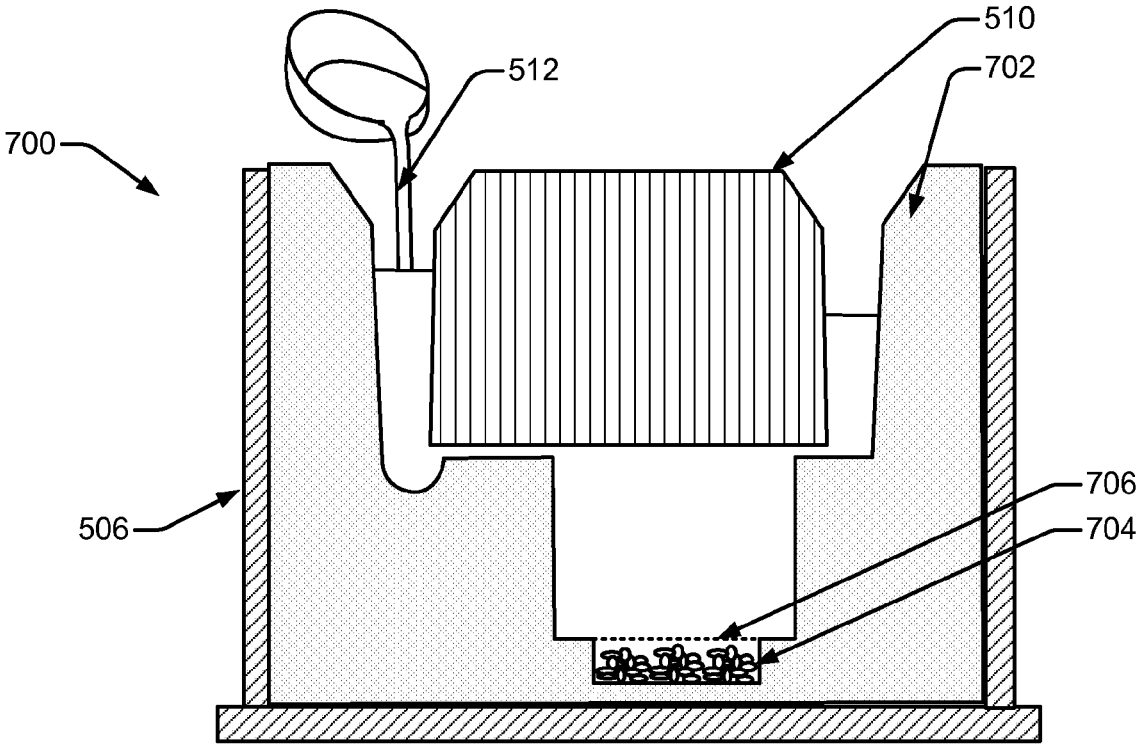
FIG. 7 is a schematic diagram of another casting mold that includes a retaining structure for loose ceramic particles.

FIG. 7 illustrates another casting mold 700 that incorporates a sand mold design 702 that provides a reservoir or indentation for the loose ceramic particles 704 that are secured in place by a retaining structure 706 placed over the reservoir. The depth and size of the reservoir may vary according to the intended use of the composite component being manufactured. Also, several reservoirs may be incorporated into the sand mold design and they may vary in shape or orientation dependent upon, again, the intended use of the composite component. In another embodiment (not illustrated), the reservoirs may be incorporated into the vertical walls of the sand mold or any other surface of the sand mold and secured in place by a retaining structure.

Figure 8:
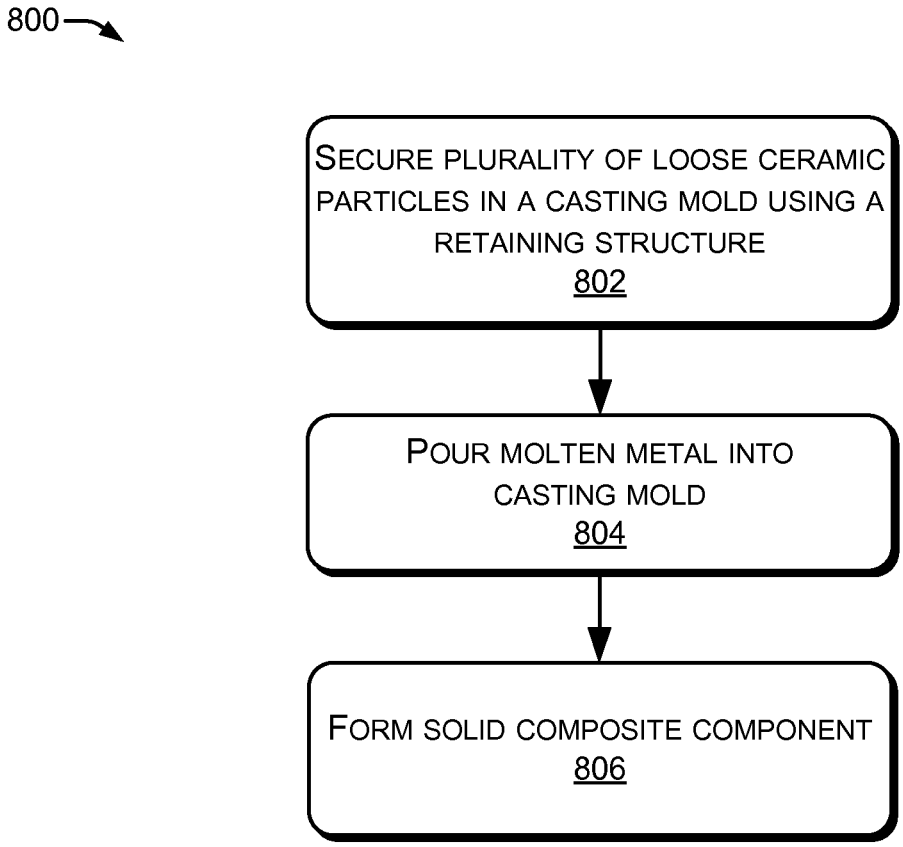
FIG. 8 is a flow diagram illustrating an example process of casting a composite component having one or more ceramic particles encapsulated in a base metal.

FIG. 8 is a flow diagram of an example method 800 of forming a composite component 600. The method 800 is described with reference to the elements of FIGS. 5-7 for convenience. However, the method 800 need not, necessarily, be performed using the example molds or to produce the example composite components described with reference to those figures. At 802, a plurality of loose ceramic particles 504 are secured in a casting mold 500 using a retaining structure 502. In one embodiment, the casting mold is a sand mold 508 that may be arranged to form the shape of the composite component 600. The retaining structure 502 may envelop all of the ceramic particles 504 as shown by 514, or the ceramic particles may be secured between the retaining structure 502 and the sand mold 508. In an alternative embodiment, more than one retaining structure may be used in the casting process. For example, three retaining structures may be used to form the composite component 606, as illustrated in FIG. 6B.

At 804, molten metal 512 is poured into the casting mold 500. The molten metal 512 permeates the retaining structure 502 and is diffused into the interstitial spaces between the loose ceramic particles 504.

At 806, the solid composite component 600 is formed when the molten metal 512 solidifies in the casting mold as the temperature of the molten metal 512 decreases.

Figure 9A:
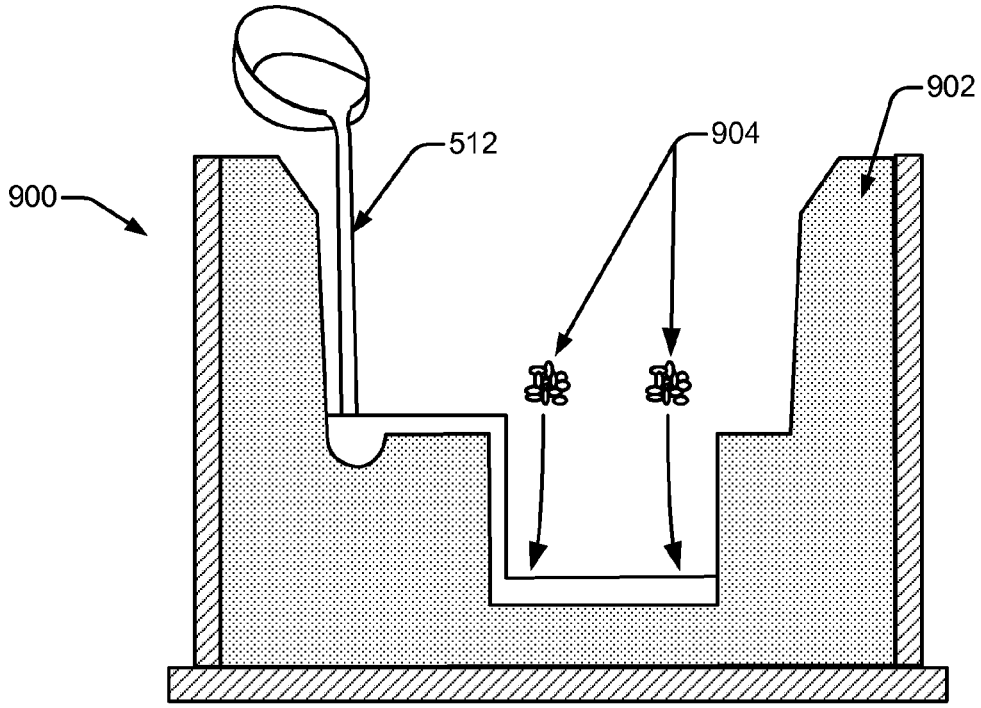
FIGS. 9A and 9B are schematic diagrams of a casting mold in different stages of a casting process for a composite component.
Figure 9B:
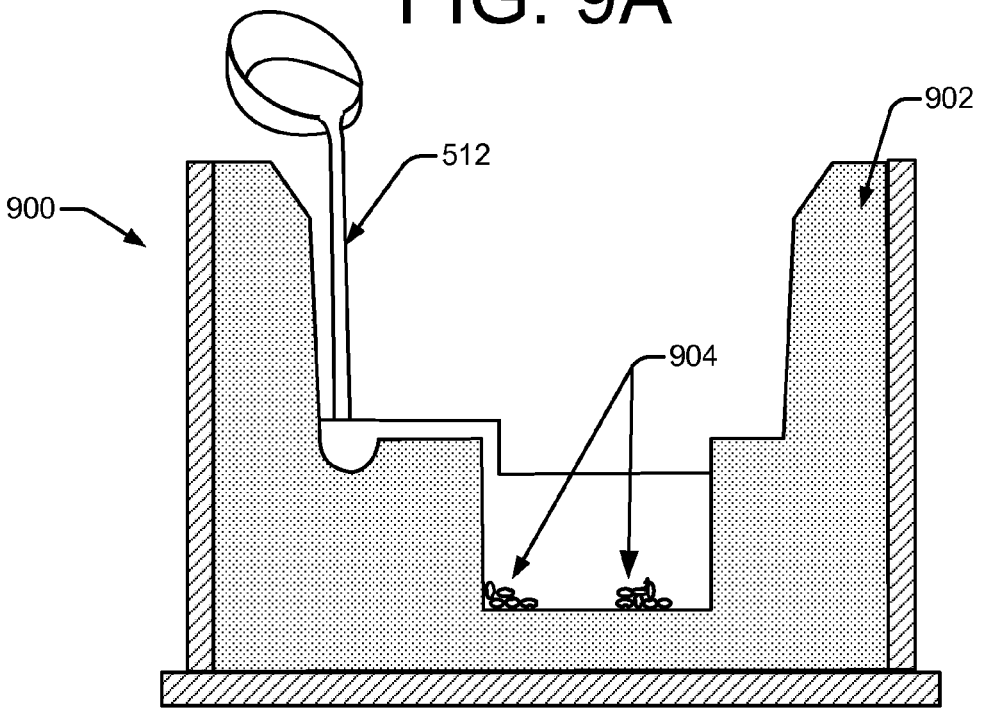

FIGS. 9A and 9B are an illustrative example of adding loose ceramic materials to a casting mold 900 when the molten metal 512 is being poured into the sand mold 902. FIG. 9A illustrates a time interval at the beginning of the process prior to introducing the loose ceramic materials 904 into the molten metal 512. In this embodiment, the molten metal 512 is being poured into the sand mold 902. The loose ceramic particles may be added to the molten metal 512 as indicated by the arrows pointing from the loose ceramic particles 904 to the molten metal 512. The timing and placement of the loose ceramic particles will be discussed in greater detail in the discussion of FIG. 10.

FIG. 9B illustrates the casting mold 700 in FIG. 9A near the end of the pouring process that was started in FIG. 9A. The loose ceramic particles 904 have been introduced into the molten metal 512 and reside in a desired location in the sand mold 902. In this embodiment, the density of the loose ceramic particles 904 is greater than the density of the molten metal 512 which enables the loose ceramic particles 904 to reside in a desired location of the sand mold 902 as the molten metal 512 is being poured. However, in another embodiment, the density of the loose ceramic particles may be less than the density of the molten metal 512, such that they float in the molten metal 512.

Figure 10:
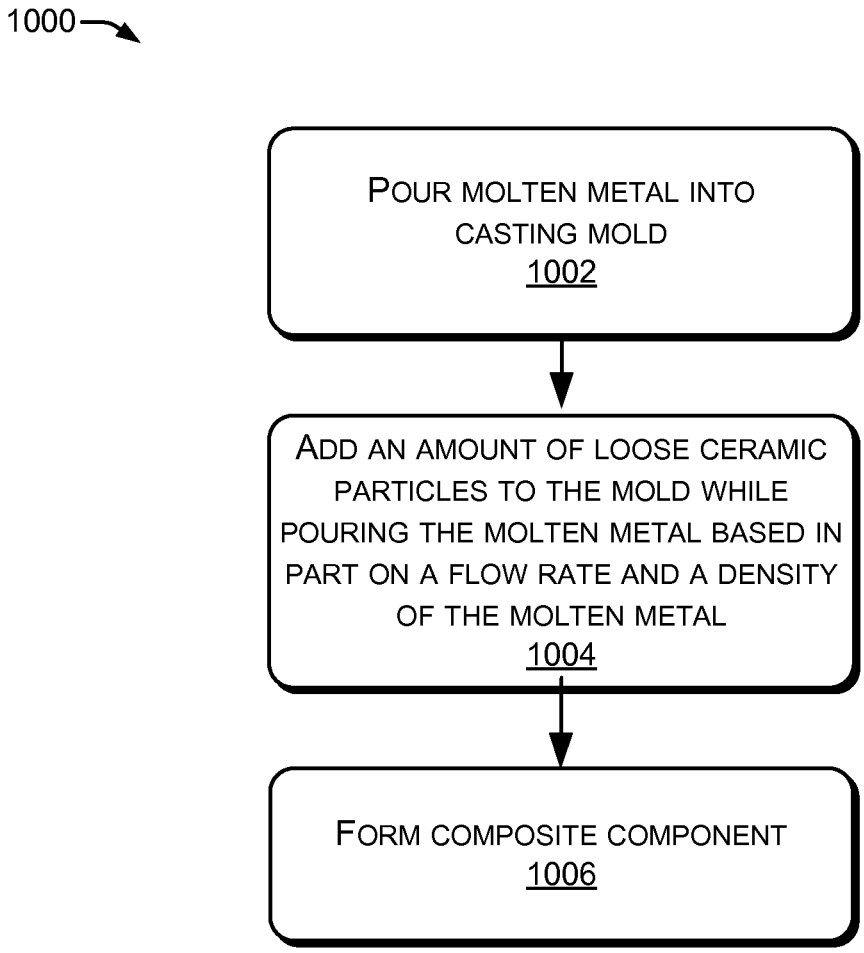
FIG. 10 is a flow diagram illustrating an example process of casting a composite component by adding ceramic particles based on processing conditions for the composite component.

FIG. 10 is a method 1000 pertaining to optimizing location of loose particles 904 during the pouring of molten metal 512 into the sand mold 902 illustrated in FIGS. 9A and 9B. At 1002, molten metal 512 is poured into the casting mold 900.

At 1004, loose ceramic particles 904 are added to the molten metal 512 at a time determined based in part on a flow rate and a density of the molten metal and a desired location of the ceramic particles in the composite component 600. The addition of the loose particles may also be based in part on a desired uniformity/non-uniformity or a desired density of the loose ceramic particles in the composite component 600. Other factors may also be used to determine when and how many loose particles are added to the sand mold 902. For example, the factors may include a temperature of the molten metal, turbulence of the molten metal, a temperature of the loose ceramic particles, and a density or a size of the loose ceramic particles. In one embodiment, the loose ceramic particles may be pre-heated to a desired temperature prior to being introduced to the molten metal. Moreover, more than one amount or group of the same or different loose ceramic particles may be added during this process. For example, a first amount of loose ceramic particles may be introduced into the molten metal at a first time (e.g., t=15s) and then a second amount of loose ceramic particles may be introduced at a second time (e.g., t=25s). Not only may the amounts vary, but different types of particles may added at different times and at different locations in the sand mold 902. Again, these variables may be determined by the intended use of the composite component.

At 1006, the composite component 600 is formed by cooling the molten metal until it solidifies.

The molten metal introduced into the mold in any of the methods described in this section may include iron, carbon steel, or an alloy of iron or steel, as the metal alloy. However, in other embodiments, other metals may be used, such as aluminum, manganese, stainless steel, copper, nickel, alloys of any of these, or the like (e.g., FeMnAl). Furthermore, in some embodiments, multiple different metals or alloys may be used.

Following the formation of the composite component 600 according to any of the methods described in this section, the composite component 600 may be subjected to one or more heat treatments or post processing operations, such as machining, heat treating (e.g., quenching, annealing, tempering, austempering, cryogenic hardening, etc.), polishing, or the like. Additional details of various heat treatments and post processing operations are described further below in the section entitled "Illustrative Manufacturing Processes."

Example Methods of Forming Composite Components by Coating a Mold

This section describes examples, in which a composite component may be formed by applying a ceramic material to a predetermined location within a mold cavity to create a ceramic film. The ceramic material may be applied to the mold cavity by coating all or part of the mold cavity with adhesive and ceramic material. The adhesive and ceramic material may be applied concurrently (e.g., as a slurry or mixture of ceramic and adhesive) or sequentially (e.g., by applying the adhesive first and then applying the ceramic material). The adhesive and/or ceramic material may be applied by, for example, brushing them onto the mold cavity, spraying them onto the mold cavity, and/or sifting them onto the mold cavity. One or more layers of ceramic film may be applied to the mold cavity using any of the techniques described herein. Molten base metal may then be introduced into the mold cavity. The molten base metal may partially, substantially, or completely permeate the ceramic film, and may encapsulate the ceramic material. In some examples, the ceramic material comprises ceramic particles and the molten base metal substantially permeates interstitial spaces between the ceramic particles.

Figure 11:
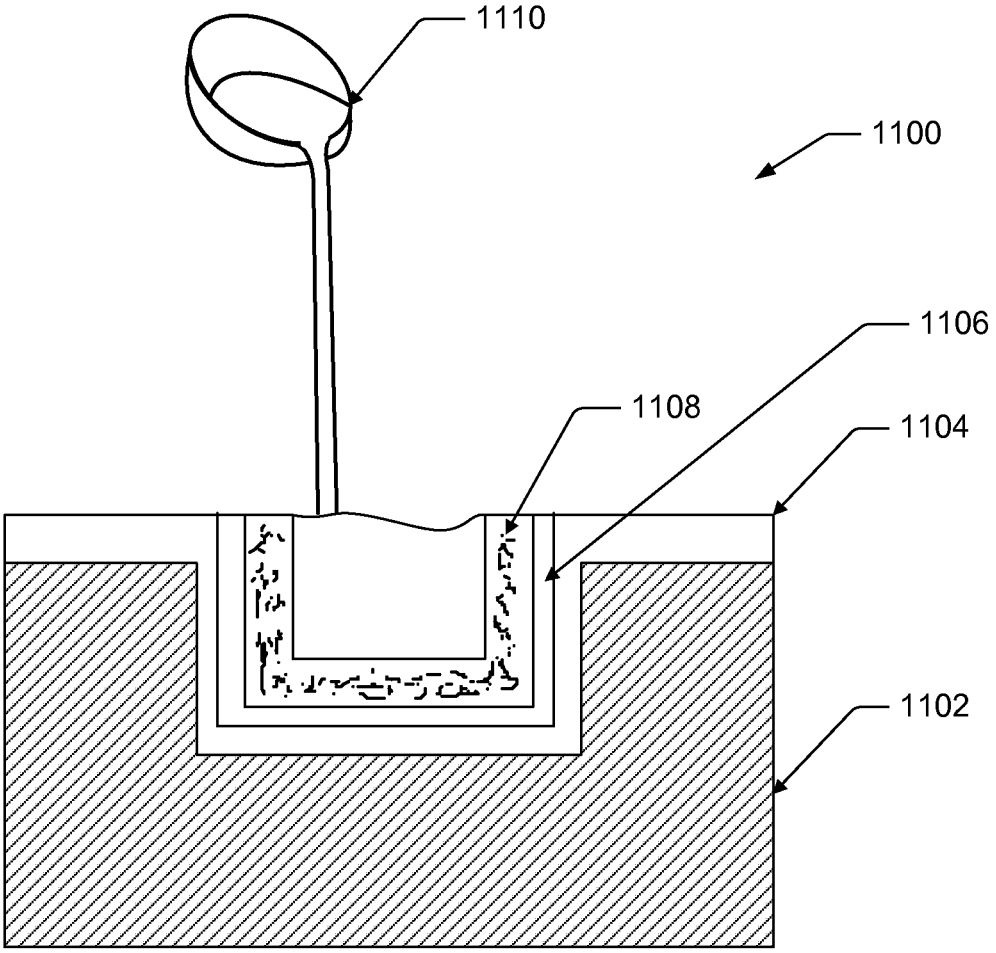
FIG. 11 is a schematic diagram of an example mold for creating a cast part incorporating ceramics in predetermined locations.

FIG. 11 is an illustration of an example mold 1100 for creating a cast part incorporating ceramics in predetermined locations. The mold may be either a sand casting mold or an investment casting mold that is used to create cast parts. The mold cavity 1102 is formed within the mold. A refractory wash 1104 is used to wash the mold cavity 1102. While the cast part may be formed without a refractory wash 1104, in most case, the use of a refractory wash 1104 is desirable. A refractory wash 1104 is used to create a film that provides for a smoother finish on the cast part. The refractory wash 1104 also serves to eliminate sand burn-in in a sand casting and provides a barrier layer which is not penetrable by the molten base metal thus preventing the molten base metal from permeating the mold itself. The refractory wash may comprise a zircon wash and/or an alumina wash.

Ceramic material 1108 is applied in predetermined locations prior to pouring in a molten metal 1110. Depending on the particular needs of an application and the precision desired, the ceramic material 1108 may be simply poured on the predetermined location. In another embodiment, the ceramic material 1108 may be held in place by a high temperature adhesive 1106 that is applied prior to the application of the ceramic material 1108 and after the application of the refractory wash 1104. As discussed in the previous section, the ceramic material 1108 may also be held in place by a high temperature mesh or a coated fabric instead of the high temperature adhesive or in addition to the high temperature adhesive. In yet another embodiment, the ceramic material 1108 may be mixed with a high temperature adhesive and applied in a sludge or slurry mixture form. In either embodiment using an adhesive, the ceramic material stays in place and the high temperature adhesive disintegrates once the molten metal 1110 is poured into the mold cavity 1102.

The ceramic material 1108 may be applied in a variety of ways. For instance, the ceramic material 1108 may be sprayed on, brushed on, sifted on, simply poured in, or applied using a combination of these processes. Prior to pouring in the molten metal, excess ceramic material 1108 that may have inadvertently been applied to areas other than the predetermined locations may be removed. This may be accomplished by vacuuming out, brushing off, or blowing off the excess ceramic material 1108. Additionally or alternatively, ceramic material may be removed from unwanted areas by masking the areas prior to applying the ceramic material 1108. The masking is further discussed with reference to FIG. 12 below. As stated earlier, the ceramic material may include alumina and/or zirconia as well as other materials such as tungsten carbide, titanium carbide and zirconia-toughened alumina. The molten metal may include iron, steel, manganese, stainless steel, copper, nickel or any combination or alloy of any of these (e.g., FeMnAl).

In some instances, multiple ceramic film layers may be applied to build up additional thickness of ceramic material. Whether or not multiple layers are used is determined by the desired thickness of the ceramic wear surface. Additional thickness in ceramic film layers may be accomplished by applying several layers of ceramic material in multiple applications to incrementally increase the surface thickness. The ceramic material used in one or more of the multiple layers may be the same as, or different from, that used in the other layers. Additionally, a ceramic core, such as those shown in FIGS. 1-3 may be placed in predetermined locations to increase the thickness in particularly high wear locations. The ceramic core may be held in place by adhesive so that no movement occurs when the molten metal in poured into the mold cavity 102.

As the molten metal 1110 is poured into the mold cavity 1102, the molten metal 1110 permeates the ceramic material 1108, i.e., the molten metal 1110 permeates the interstitial spaces between the ceramic particles. However, the molten metal 1110 does not permeate the refractory wash 1104. Consequently, as the molten metal 1110 cools, a cast part is formed with a ceramic particle wear surface formed within the cast part at predetermined locations. The predetermined locations are typically the portion of the cast part that will be exposed to the most wear, whether from impact, abrasion, or other wear.

Figure 12:
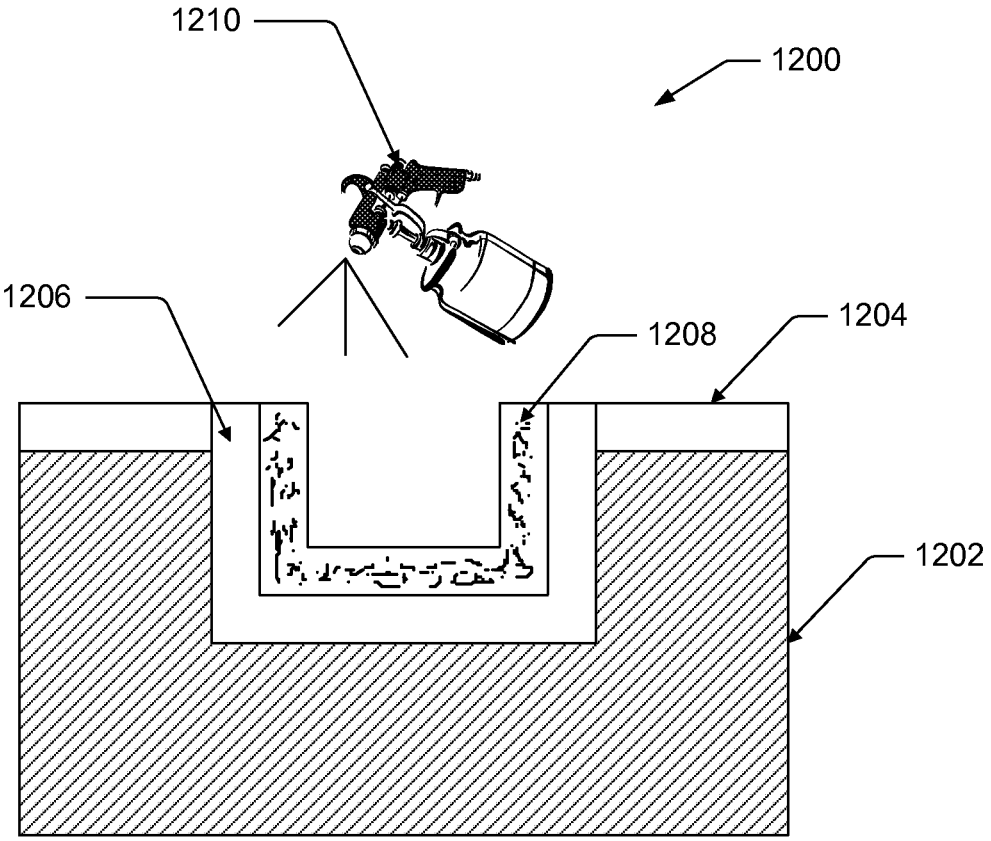
FIG. 12 is a schematic diagram illustrating an example technique of spray-coating a mold with ceramic material in predetermined locations.

FIG. 12 is an illustration of a mold 1200 for creating a cast part incorporating ceramics in predetermined locations. This mold 1200 is similar to that described in FIG. 11 above. The mold 1200 includes a mold cavity 1202. In this embodiment, a mask 1204 is applied to portions of the mold cavity 1202 in which ceramic material is not desired. The mask 1204 may be any type of material that prevents the ceramic material 1208 from adhering to the material or makes the material easy to blow off, scrape off or brush off. For instance, the mask 1204 may be a removable tape with a sticky surface on one or both sides. The mask 1204 is applied to the areas other than the predetermined locations and held in place by one side of the adhesive tape. After the ceramic material 1208 is applied, the mask 1204 is removed prior to pouring in a molten metal, thus removing any oversprayed ceramic material 1208. A mask 1204 provides for easy removal of the excess ceramic material that is located in areas where ceramic material is not desired.

A refractory wash 1206 is applied to a predetermined location and the ceramic material 1208 is applied to the predetermined location over the refractory wash 1206 using a sprayer 1210. The refractory wash 1206 may also be applied to the entire mold cavity 1202 before both the mask 1204 and the ceramic material 1208 are applied. Since the refractory wash 1206 helps to provide a smoother finish to the cast part and prevents sand burn-in in sand casting, it may be desirable to apply the refractory to the entire mold cavity 1202 and not just the predetermined locations. In this embodiment, ceramic material is applied concurrently with an adhesive by the sprayer 1210. However, in other embodiments, the adhesive may be applied first to the predetermined locations and the ceramic material may be applied subsequently by pouring or sifting the ceramic material onto the locations coated with the adhesive. While a hand sprayer is shown, the spraying mechanism may be part of a manufacturing operation and be automated.

After the excess ceramic material 1208 is removed from the areas other than the predetermined locations, the molten metal in poured into the mold cavity 1202 and allowed to cool to form a cast part. This embodiment also allows the cast part to be formed in thin sizes that are smaller than those normally able to be cast with a ceramic wear surface.

Figure 13:
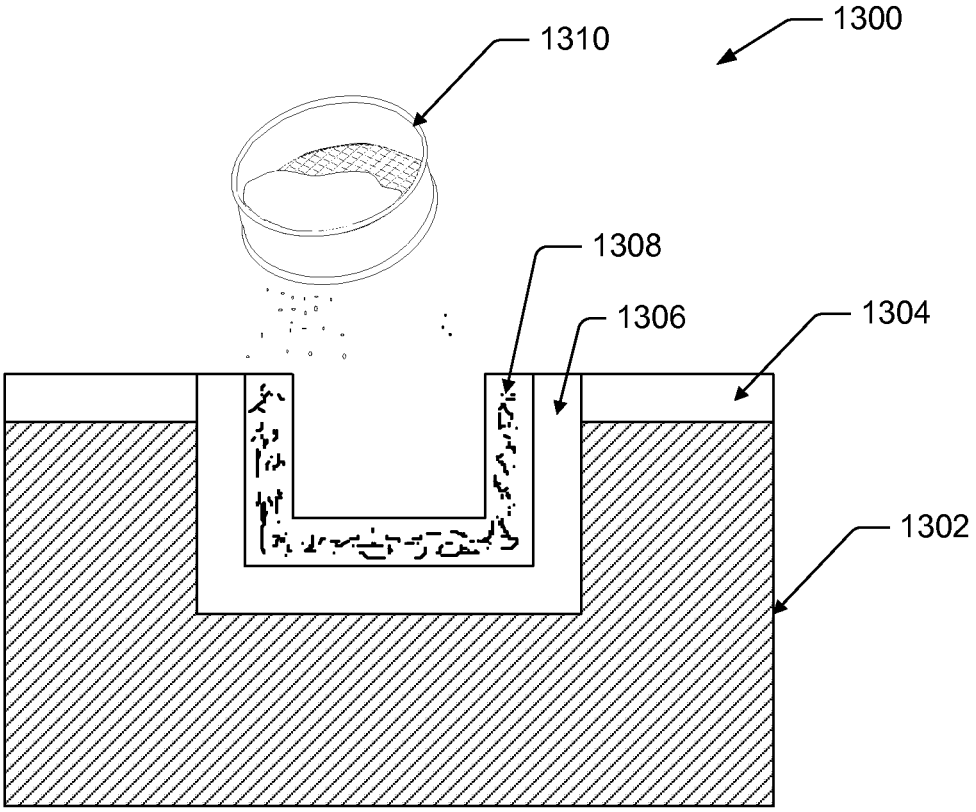
FIG. 13 is a schematic diagram illustrating an example technique of sift-coating a mold with ceramic material in predetermined locations.

FIG. 13 illustrates another embodiment of a mold 1300 for creating a cast part incorporating ceramics in predetermined locations. This mold 1300 is similar to that described in FIG. 12 above except for the means for applying the ceramic material. The mold 1300 includes a mold cavity 1302. A mask 1304 is applied to portions of the mold cavity 1302 in which ceramic material is not desired. A refractory wash 1306 is applied to the mold cavity 1302. Finally, the ceramic material 1308 is applied to the predetermined locations using a sifter 1310. Again, if desired, multiple layers of the ceramic material 1308 may be applied to create a desired thickness of ceramic material. In addition to or in lieu of the multiple layers, a ceramic core may also be placed in the predetermined locations to increase the ceramic wear surface thickness in certain areas. Since a sifter 1310 is not as precise as other application methods, the use of the mask 1304 may be more useful for removing the excess ceramic material from use of the sifter 1310 prior to pouring in a molten metal to form a cast part. After the overspray is removed, the molten metal is poured into the mold cavity 1302 and allowed to cool to form a cast part.

Figure 14:
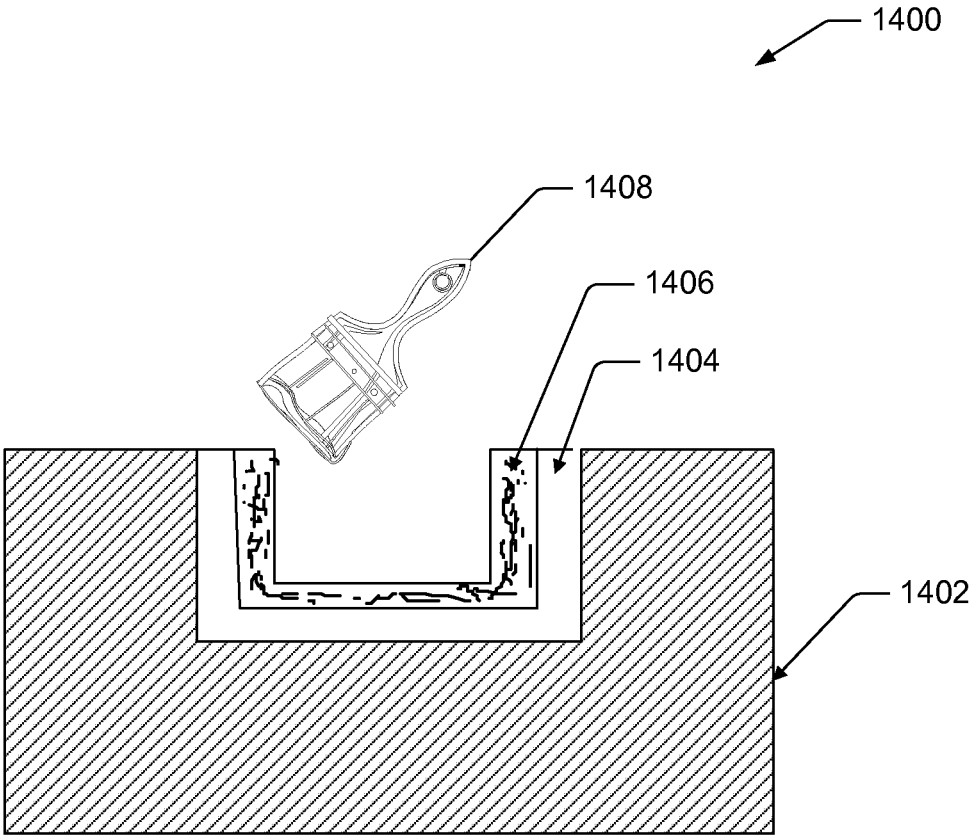
FIG. 14 is a schematic diagram illustrating an example technique of brush-coating a mold with ceramic material in predetermined locations.

FIG. 14 is another embodiment of a mold 1400 for creating a cast part incorporating ceramics in predetermined locations. This mold 1400 is similar to that described in FIG. 12 above except for the means for applying the ceramic material. The mold 1400 includes a mold cavity 1402. In this embodiment, the ceramic material 1406 is applied to the predetermined locations using a brush 1408. The use of a mask is optional given the more precise application of using a brush 1408. In the event a mask is used, the mask is applied to portions of the mold cavity 1402 in which ceramic material is not desired. A refractory wash 1404 is again applied to the mold cavity 1402 to improve the finish of the cast part and maintain mold integrity. Finally, the ceramic material 1406 is applied to the predetermined locations using a brush 1408. Again, if desired, multiple layers of the ceramic material 1406 may be applied to create a desired thickness of ceramic material. In addition to or in lieu of the multiple layers, a ceramic core may be placed in the predetermined locations to increase the ceramic wear surface thickness in certain areas. After the excess ceramic material 1406 is removed, the molten metal in poured into the mold cavity 1402 and allowed to cool to form a cast part.

Figure 15:
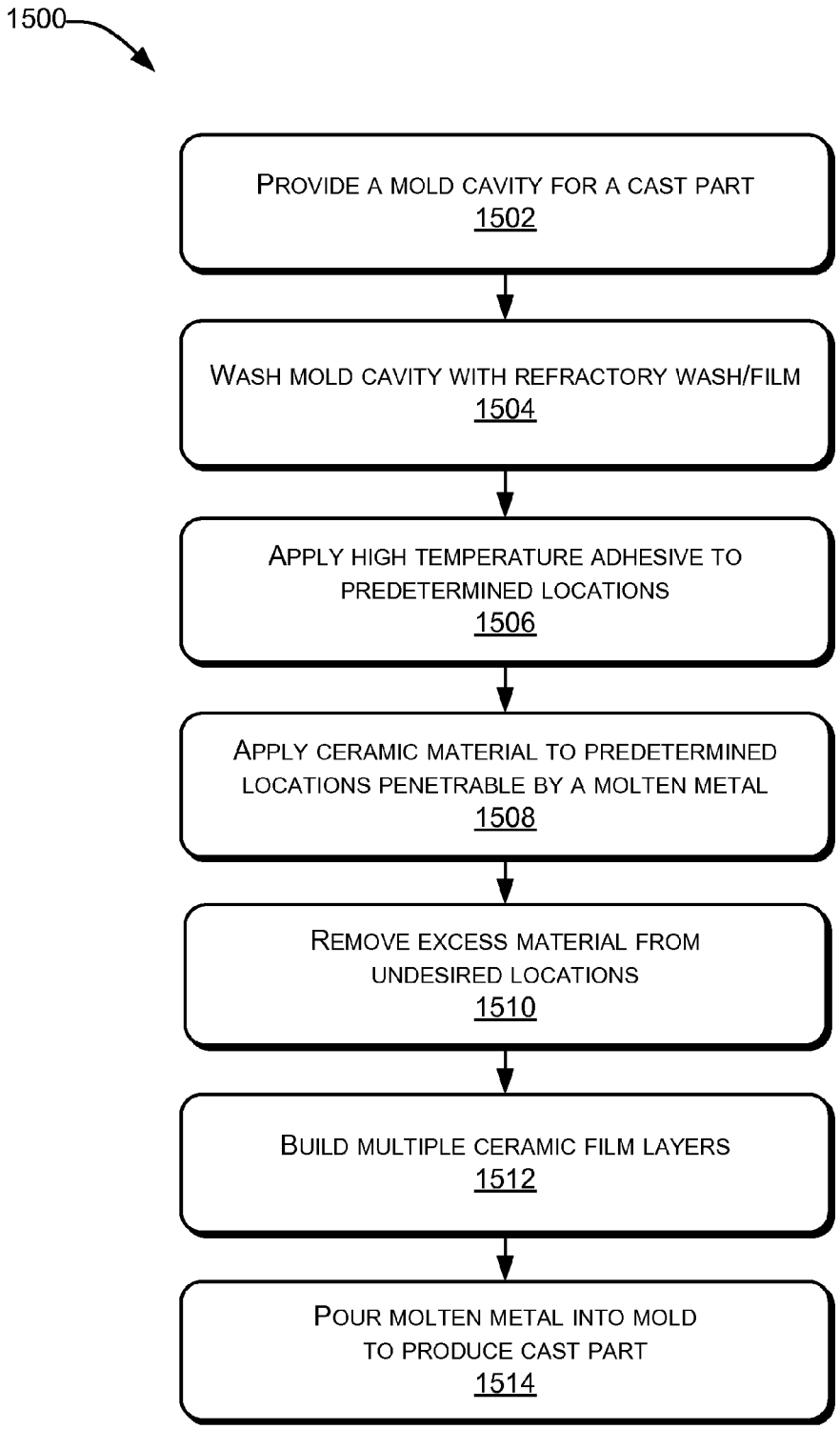
FIG. 15 is a flow diagram illustrating an example method of producing a composite component by coating a mold with ceramic material.

FIG. 15 is a flow diagram illustrating a method 1500 of producing a cast part. At 1502, a mold cavity is provided that is formed to produce the cast part. The mold cavity is washed with a refractory wash to create a film over the mold cavity at operation 1504. The refractory wash provides for a smoother finish on the cast part and provides a barrier to prevent the molten metal from permeating the mold. A high temperature adhesive is applied over the refractory wash to predetermined locations in operation 1506. The predetermined locations are selected based on the location of the wear surfaces of the cast part. Typically, the ceramic material is applied to a wear surface in those areas where the most wear occurs.

The ceramic material is applied to the predetermined locations in operation 1508. The ceramic material is penetrable by the molten metal, i.e., the molten metal permeates the interstitial spaces between the ceramic particles. The ceramic material may be applied in many different ways, including pouring on, spraying on, brushing on and sifting on. In addition, the ceramic material and adhesive may be applied separately as just described or the ceramic material and adhesive may be mixed together prior to application such that the mixture in the form of a sludge or slurry type of mixture that can be applied to the predetermined locations. The ceramic material may be held in place by a high temperature mesh or a coated fabric instead of the high temperature adhesive or in addition to the high temperature adhesive.

Any excess ceramic material may be removed from undesired locations at operation 1510. The excess material may be due to overspray or spillage that is inadvertently applied outside the predetermined locations. The removal of the excess ceramic material may be accomplished by vacuuming off, blowing off, or brushing off the excess ceramic material, or by masking the areas prior to applying the ceramic material. The mask may be any type of material that prevents the ceramic particles from adhering to the mold or makes the material easy to blow off, vacuum off, scrape off or brush off. For instance, the mask may be a removable tape with a sticky surface on one or both sides. This would allow the mask to be removed prior to pouring in a molten metal, thus removing any oversprayed or overapplied ceramic material.

In some instances, multiple ceramic film layers are built in operation 1512. Whether or not multiple layers are used is determined by the desired thickness of the ceramic wear surface. The additional thickness in ceramic film layers may be accomplished by applying several layers of ceramic material to incrementally increase the surface thickness and/or a ceramic core may be placed in the mold cavity to add additional thickness.

In operation 1514, molten metal is poured into the mold to produce the cast part. The molten metal permeates the ceramic material layer/layers, but does not permeate the refractory wash film. As the molten metal cools, the cast part is formed and the ceramic wear surface becomes an integral portion of the cast part.

The embodiments described in this section allow for the formation of cast parts having relatively thin cross-sections—smaller than those normally able to be cast with a ceramic wear surface. For instance, this process can be used to cast parts as thin as 0.25 inches. In some embodiments, this process can be used to cast parts having a thickness of between about 0.25 inches and about 1.5 inches. In addition, thicker cast parts are also able to be formed using this embodiment.

Illustrative Manufacturing Processes

The composite components described herein can be made by a variety of manufacturing processes. In one example, the ceramic materials are placed in a mold according to one of the techniques described above. As noted above, the ceramic materials may be preheated prior to casting to remove moisture and/or to elevate the temperature of the ceramic material to slow solidification of the base metal during the casting process for better permeation into the ceramic material. The composite component may then be formed by injecting molten base metal into molds using conventional casting techniques. Subsequently, the composite component may be subjected to one or more post processing operations, such as machining, heat treating (e.g., quenching, annealing, tempering, austempering, cryogenic hardening, etc.), polishing, or the like. Various heat treatments can implement phase changes in the metal of the composite component that allow the wear or impact resistant characteristics to be varied to account for different uses of the composite component part. Heat treatment techniques may also be used to reduce internal stresses in the composite components due to different coefficients of thermal expansion of the base metal and the ceramic materials, thereby reducing cracking or voids in the composite components.

Previous attempts to quench metal/ceramic composite materials have been unsuccessful due to the different characteristics of the metal and ceramic materials. However, several processes used separately or in combination may facilitate quenching of metal/ceramic components. For example, internal stresses of metal/ceramic components may be reduced by preheating the ceramic materials prior to casting, choosing ceramics and metals having relatively similar coefficients of thermal expansion, using relatively smaller ceramic particles, employing a quench with a relatively higher quench temperature, such as austempering, and/or employing a quench medium with a relatively lower rate of quench (e.g., air).

In one embodiment, the wear and/or impact resistance of a composite component can be modified by austempering. Generally, austempering refers to the isothermal transformation of a ferrous alloy at a temperature below that of pearlite formation and above that of martensite formation. Further, the metal may be cooled to the austempering temperature fast enough to avoid transformation of austenite during cooling. Then the component is held at a constant temperature long enough to ensure complete transformation of austenite to bainite. Austenite, martensite, pearlite, and bainite are common metallurgical terms that represent the various phases or crystal structures in which ferrous alloys may exist. Austenite is a metallic non-magnetic allotrope of iron or a solid solution of iron, with an alloying element such as nickel that has a face-centered cubic structure. Pearlite is a layered crystal structure of cementite and ferrite formed during the cooling of austenite. Martensite is a constituent formed in steels by rapid quenching of steel that is in the austenite phase. It is formed by the breakdown of austenite when the rate of cooling is large enough to prevent pearlite forming in the steel. The martensite crystal structure is generally known to be a body-centered tetragonal crystal structure. Bainite is produced when austenite is transformed at temperatures below the pearlite and martensite temperature ranges of ferrous alloys.

By way of example and not limitation, austempering may include placing the composite component in a salt bath that is maintained at a temperature between about 500 C and about 900 C. The temperature is maintained at a substantially constant value during the austempering process to insure complete transformation of the metal alloy in the composite component from austenite to bainite. Also, the salt bath may include neutral salts that are not reactive with the metal or metal alloys included in the composite component.

In another embodiment, the wear and/or impact resistance of a composite component can be modified by air quenching. Air quenching may involve placing the composite component in atmospheric conditions and permitting the composite component to cool over a period of time in order to implement a phase change in the metal of the composite component. In other implementations, the composite component may be subjected to elevated or lowered air temperatures to alter the temperature differential between the component and the air. Additionally or alternatively, air quenching may also include subjecting the component part to forced air drafts to implement a different phase change of the metal in the composite component due changes in heat transfer caused by the forced air drafts.

In another embodiment, the wear and/or impact resistance of a composite component can be modified by oil quenching. Oil quenching may involve placing the composite component in an oil bath that is maintained at a constant temperature. By way of example and not limitation, the oil bath may be maintained at a temperature of at least about 150 C. Also, the types of oil may include oils that have a high flash point that prevents the oil from catching fire. Additionally, the composite component may be placed in additional oil baths following the quenching process to temper the metal in the composite component. By way of example and not limitation, the tempering process may involve several baths with temperatures ranging from about 150 C to about 650 C.

In another embodiment, the wear and/or impact resistance of a composite component can be modified by polymer quenching. Again, the quenching process may include placing the composite component in a polymer bath in order to control the cooling rate of the metal in the composite component. By way of example and not limitation, the polymer bath may include a mix of water and glycol polymers at temperatures ranging from room temperature to about 400 C.

In another embodiment, the wear and/or impact resistance of a composite component can be modified by water quenching by placing the composite component in a water bath. The temperature of water bath is maintained at a value less than the boiling point of water.

The heat treatments described above may be used alone or in combination with each other. For example, an austempering process may be followed by air quenching or oil quenching/tempering. Additionally, the liquid quenching techniques described above may use agitation of the liquid to modify the heat transfer characteristics of the heat treatments to impart various wear and/or impact resistant characteristics to the metal in the composite component.

CONCLUSION

Although the disclosure uses language specific to structural features and/or methodological acts, the claims are not limited to the specific features or acts described. Rather, the specific features and acts are disclosed as illustrative forms of implementing the invention. For example, the various embodiments described herein may be rearranged, modified, and/or combined. As another example, one or more of the method acts may be performed in different orders, combined, and/or omitted entirely, depending on the composite component to be produced.

What is claimed is:

1. A method comprising:

securing a plurality of loose ceramic particles within a retaining structure in a casting mold, the retaining structure encloses the loose ceramic particles in at least two directions and is permeable to molten metal and impermeable by the ceramic particles, the secured plurality of loose ceramic particles having interstitial spaces between the ceramic particles such that the plurality of loose ceramic particles are unconstrained to each other;

pouring a molten steel-alloy into the casting mold, the molten steel-alloy permeates the retaining structure and the interstitial spaces between the ceramic particles; and forming a solid composite component comprising the ceramic particles and a solidified steel-alloy, the solidified steel-alloy being formed by the cooling of the molten steel-alloy.

2. The method of claim 1, wherein the retaining structure being in contact with an interior surface of the casting mold.

3. The method of claim 1, wherein the securing of the ceramic particles includes securing the ceramic particles in part by the retaining structure and in part by the casting mold.

4. The method of claim 1, wherein the solidified steel-alloy includes FeMnAl.

5. The method of claim 1, wherein the retaining structure comprises a metal wire mesh, a fabric structure, and/or a ceramic mesh structure.

6. The method of claim 1, wherein the plurality of loose ceramic particles is a first plurality of loose ceramic structures and the retaining structure is a first retaining structure, further comprising securing a second plurality of loose ceramic particles in the casting mold using a second retaining structure that is permeable to molten metal and impermeable by the ceramic particles, the second retaining structure being placed in the casting mold.

7. The method of claim 6, wherein the first plurality of loose ceramic particles includes ceramic particles of a first type and the second plurality of loose ceramic particles includes ceramic particles of a second type.

8. The method of claim 1, wherein the plurality of loose ceramic particles includes a first type of ceramic particles and a second type of ceramic particles.

9. The method of claim 1, wherein the retaining structure is in contact with or secured to the casting mold and the loose ceramic particles are between the retaining structure and the casting mold.

10. The method of claim 1, wherein the retaining structure envelops the loose ceramic particles.

11. The method of claim 1, wherein a first portion of the retaining structure is formed by the casting mold and a second portion of the retaining structure is formed by a structure other than the casting mold.

12. A method comprising:

securing a plurality of loose ceramic particles within a retaining structure in a casting mold, the retaining structure is permeable to molten metal and impermeable by the ceramic particles, the plurality of loose ceramic particles being loose via interstitial spaces between the ceramic particles that are free of an adhesive;

pouring a molten steel-alloy into the casting mold, the molten steel-alloy permeates the retaining structure and the interstitial spaces between the plurality of loose ceramic particles; and forming a solid composite component comprising the plurality of ceramic particles and a solidified steel-alloy, the solidified steel-alloy being formed by the cooling of the molten steel-alloy.

13. A method comprising:

securing a plurality of loose ceramic particles within a retaining structure in a casting mold, the retaining structure is permeable to molten metal and impermeable by the ceramic particles, the retaining structure comprising a plurality of metal wires arranged in a metal wire mesh or a plurality of fabric strips arranged in a mesh structure;

pouring a molten steel-alloy into the casting mold, the molten steel-alloy permeates the retaining structure and interstitial spaces between the ceramic particles; and forming a solid composite component comprising the ceramic particles and a solidified steel-alloy, the solidified steel-alloy being formed by the cooling of the molten steel-alloy.

* * * * *